US012458161B2

(12) United States Patent
Chakravaram

(10) Patent No.: US 12,458,161 B2
(45) Date of Patent: Nov. 4, 2025

(54) LEANING CONTAINER HOLDER OF NASHVILLE

(71) Applicant: Vishnu Vardhan Chakravaram, Gallatin, TN (US)

(72) Inventor: Vishnu Vardhan Chakravaram, Gallatin, TN (US)

(73) Assignee: Vishnu Vardhan Chakravaram, Gallatin, TN (US)

( * ) Notice: Subject to any disclaimer, the term of this patent is extended or adjusted under 35 U.S.C. 154(b) by 69 days.

(21) Appl. No.: 18/238,484

(22) Filed: Aug. 26, 2023

(65) Prior Publication Data

US 2024/0122388 A1 Apr. 18, 2024

Related U.S. Application Data

(60) Provisional application No. 63/401,129, filed on Aug. 26, 2022.

(51) Int. Cl.
*A47G 23/02* (2006.01)

(52) U.S. Cl.
CPC ..... *A47G 23/0241* (2013.01)

(58) Field of Classification Search
CPC ..... A47G 23/0241; A47G 23/02; A47G 23/0208; A47G 23/0216; A47G 23/0258; A47G 23/0266; A47G 23/0316
USPC ..... 248/146
See application file for complete search history.

(56) References Cited

U.S. PATENT DOCUMENTS

| | | | | | |
|---|---|---|---|---|---|
| 1,886,619 | A * | 11/1932 | Arnone | A61J 9/0638 | 248/105 |
| 3,365,911 | A * | 1/1968 | Schneider | F25D 3/08 | 62/457.4 |
| D282,969 | S * | 3/1986 | Sukoff | D24/199 | |
| 5,720,456 | A * | 2/1998 | Szybura | B23K 7/10 | 248/176.1 |
| D829,510 | S * | 10/2018 | Harms | D7/619.1 | |
| 2007/0295685 | A1* | 12/2007 | Mann | A47G 23/0241 | 215/392 |
| 2013/0220969 | A1* | 8/2013 | Miller | A47G 19/22 | 29/428 |
| 2014/0166827 | A1* | 6/2014 | Berry | A47G 23/0241 | 248/176.1 |
| 2015/0083880 | A1* | 3/2015 | Berry | A47G 23/0241 | 248/346.01 |
| 2016/0109176 | A1* | 4/2016 | Harms | F25D 31/007 | 62/457.5 |
| 2024/0215743 | A1* | 7/2024 | Brady | A47G 23/0241 | |

* cited by examiner

*Primary Examiner* — Christopher Garft

(57) ABSTRACT

The above discussed invention is all about a curved surface leaned at an angle that provides support for a container to rest at angle like that of the curved surface. By providing an angled curved surface, the container support system intends to help a user to easily transfer or unload a scoop of baby formular or anything similar into the container that is placed on the angled curved surface. Resting a container at a specific angle helps load formula without spilling and most importantly without the need for second hand.

7 Claims, 5 Drawing Sheets

LEANING CONTAINER HOLDER OF NASHVILLE

SUMMARY OF THE INVENTION

The invention is directed towards a holder device which facilitates a stable angular position for any container of any shape within the dimensions of the holder device. The holder device may be made of flexible material that may deform when an object or a container is placed on it and retrieves into its original shape after the object or container is removed from the device. The holder device has horseshoe shaped base which provides extended support to the various parts of the device when an object is placed on the device. The holder device also has a vertical rib which supports the angled semicircular cylindrical base on which an object or a container may be placed. The angled semicircular cylindrical base has a circular rib that prevents a container or an object from tripping in the forward direction by holding on to it. The angled semicircular cylindrical base also has a circular base which stops the object or the container from sliding down the angled semicircular cylindrical base. Between the horseshoe base and the angled semicircular cylindrical base in addition to vertical rib there is also a circular edge that provides additional support to the angled semicircular cylindrical base.

The user while holding a baby in one hand cannot load formula into the milk bottle which is a cylindrical container with narrow mouth and would eventually need the second hand of his to hold the bottle at an angle to be able to feed the formula into the cylindrical container with narrow mouth and to not spill any formula outside the cylindrical container with a narrow mouth. A cylindrical container with narrow mouth when placed on the holder device rests on the angled semicircular cylindrical base thus inheriting the angle of it as well. The angle at which cylindrical container with narrow mouth is positioned becomes a convenient position to easily load a scope full of formula into the cylindrical container with narrow mouth using only one hand, while holding the baby on the other hand.

A Tumbler full of ice and some liquid when placed on the angled semicircular cylindrical base of the holder device inherits the angle and thus is positioned in such a way that the gravity will pull all the liquid present between the ice cubes to be collected in the right-angle area between the wall of container and base of the container allowing the user to sip the entire liquid present in the Tumbler.

A Tumbler for with ice when placed on the angled semicircular cylindrical base of the holder device inherits the angle and thus is positioned in such a way that when a known to form causing liquid is poured into the Tumbler does not cause form and prevents the user to take a pause between each pour for the foam to settle down.

A water bottle with inbuilt straw when placed on the angled semicircular cylindrical base of the holder device inherits the angle and thus is positioned in such a way that the user does not have to hold the bottle at an angle and sip the water hands free.

With reference to U.S. provisional patent application No. 63/401,129, the device described there in is equivalent to the holder device described here in.

The summary of the invention is provided as a general introduction and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description explain the principles of the invention.

DETAILED DESCRIPTION OF THE ILLUSTRATED EMBODIMENTS

As used herein the terms comprises, comprising, includes, including, has, having, or any other variation thereof are intended to cover a nonexclusive inclusion, for example a process method article or apparatus that comprises a list of elements is not necessarily limited to only those elements but may include other elements not expressly listed or inherent to such process method article or apparatus. Also, use of a or and are employed to describe elements and components described herein. This is done merely for convenience and to give a general sense of scope of the invention. This description should be read to include one or at least one end singular also includes the plural unless it is obvious that it means otherwise.

Certain exemplary embodiments of the present invention are described herein and illustrated in the accompanying figures. The embodiment described are only for purposes of illustrating the present invention and should not be interpreted as limiting the scope of the invention other embodiments of the invention and certain modifications combinations and improvements of the described embodiments will occur to those skilled in the art and all such alternate embodiments combinations modifications improvements are within the scope of the present invention.

Figure 1:
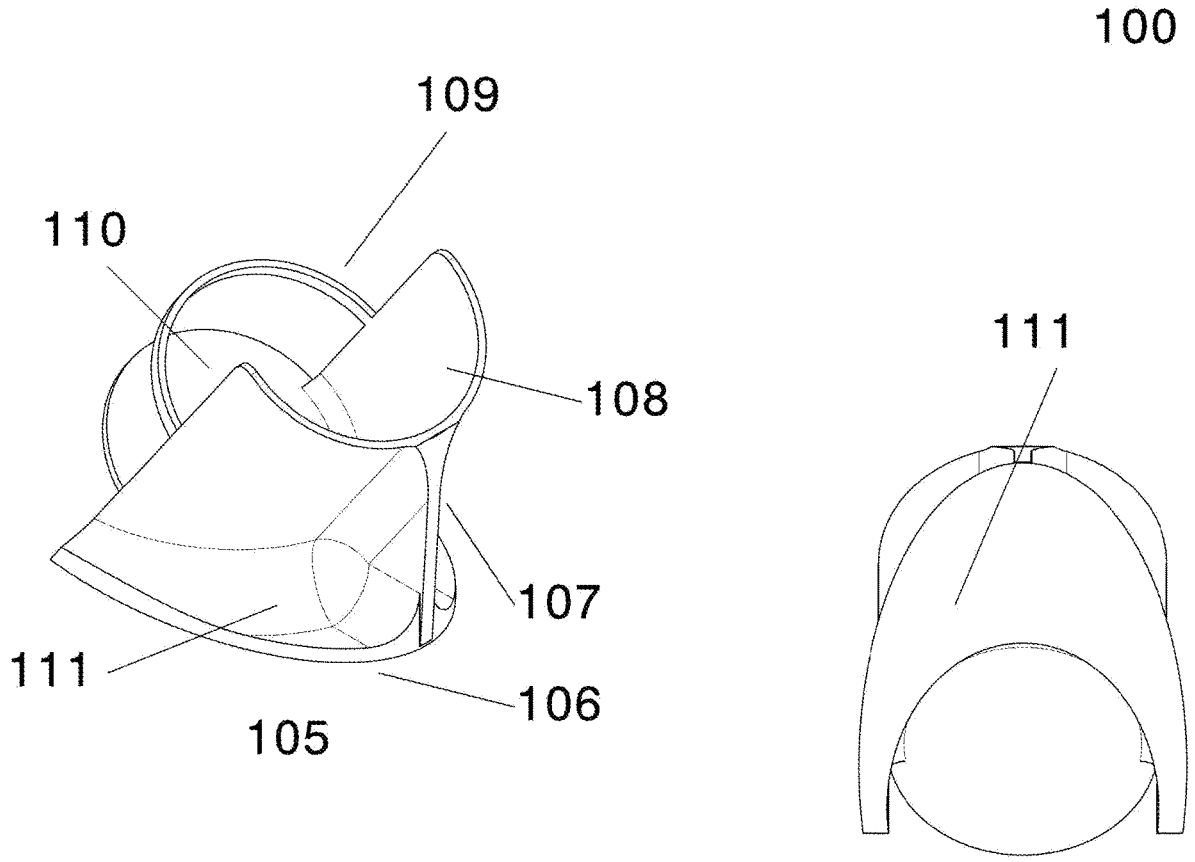
FIG. 1 shows a perspective of the holder device of the present invention in isometric view.

Referring to FIG. 1, an exemplary holder device 105, has a horseshoe base 106 on which vertical rib 107 rests and angled semi circular cylinder base 108 rests on both vertical rib 107 and horseshoe base 106. Perpendicular to the angled semicircular cylinder base 108, extends out a circular rib 109. This circular rib 109 acts as a trip preventer for an object that is placed on the holder device 105. Perpendicular to the angled semicircular cylinder base 108 extends out a circular base 110 which acts as a base for any object to be placed on the holder device 105. The circled edge 111, gives support for angle semicircular cylindrical base 108.

Horseshoe base 106 provides extended support spanning at an angle on either side of the device. Rib 107 that is resting on the horseshoe base 106 provides support to the angled semicircular cylinder base 108 from bending forward when an object was placed on the holder device 105. The holder device 105 is made-up of a material that is flexible allowing an object that is slightly bigger than the diameter of the semicircular cylindrical base 108 to be able to place on the holder device 105.

Figure 2:
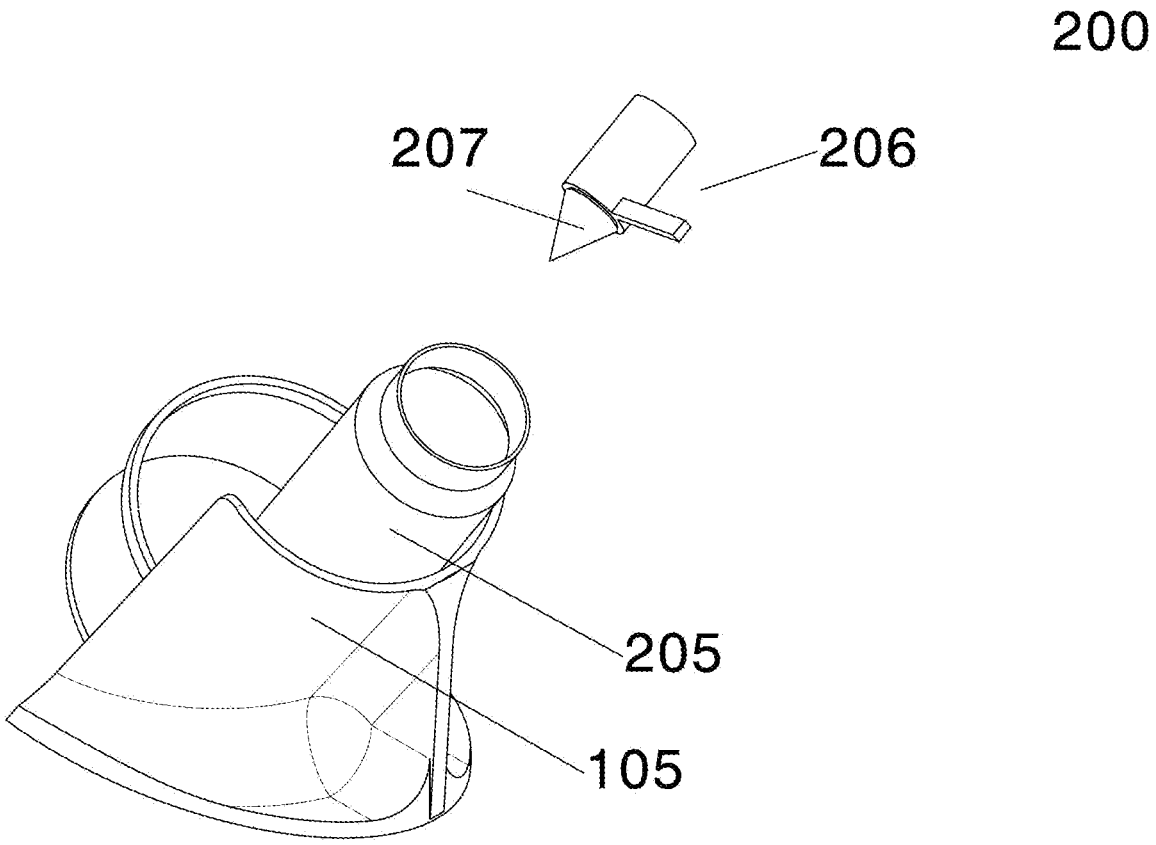
FIG. 2 shows a perspective of the holder device of the present invention in isometric view, with a container placed on it and powered content being loaded in the container with a scoop.

Referring now to FIG. 2 the holder device 105 can accommodate any object within or a little over the diameter of the angled semicircular cylindrical base 108 at an angle, while the object rests on the circular base 110. As cylindrical container with a narrow mouth 205 is shown resting on angled semicircular cylindrical base 108 and circular base 110. The angled semicircular cylindrical base 108 and circular base 110 thus was able to put the cylindrical container with a narrow mouth 205 at an angle. Due to the weight of the cylindrical container with narrow mouth 205 the angled semicircular cylindrical base 108 may bend forward causing this cylindrical container with narrow mouth 205 to trip forward, however the rib 107 and this circled edge 111, prevents the angled semicircular cylindrical base 108 from bending forward. The angle at which the cylindrical container with narrow mouth 205 is held gives easy access for a user to load content 207 into the cylindrical container with a narrow mouth 205 using scoop 206 with only one hand without the need of other hand to hold the cylindrical container 205 at an angle and without spilling the powdered content 207.

Figure 3:
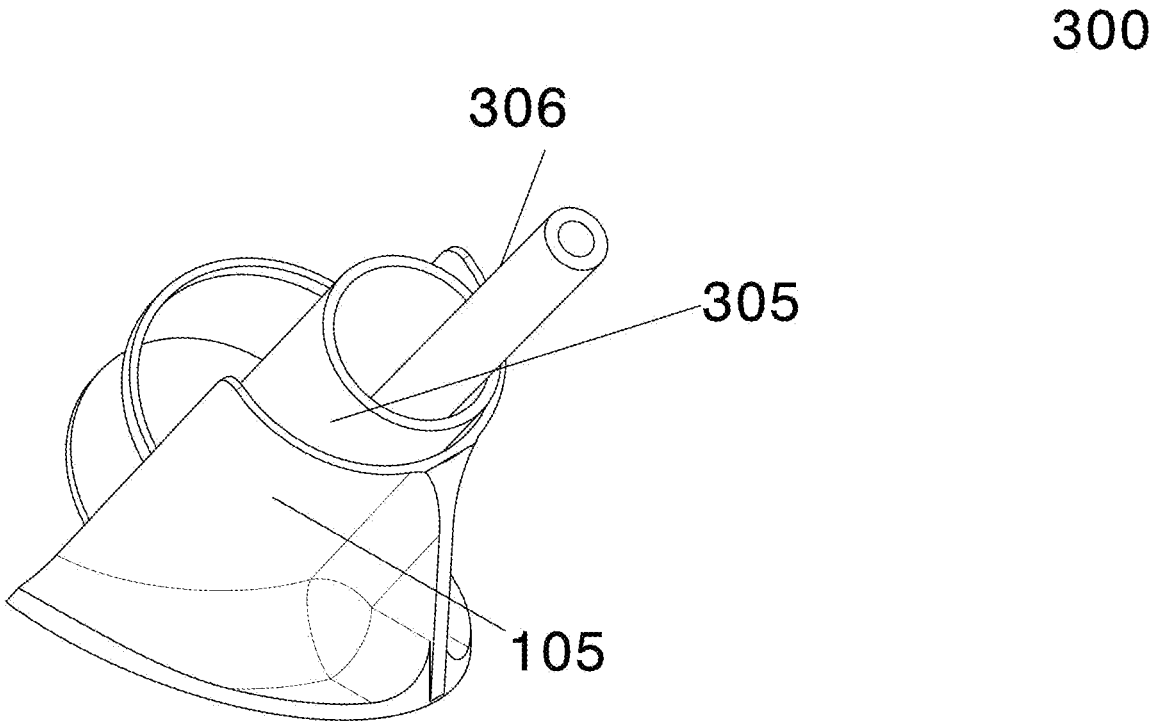
FIG. 3 shows a perspective of the holder device of the present invention in isometric view, with a tumbler and straw.

Referring now to FIG. 3 the holder device 105, accommodates tumbler 305. Tumbler 305 inherits the angle from angled semicircular cylindrical base 108 and rests on circular base 110. Due to the angle inherited by the Tumblr 305 from angled semicircular cylindrical base 108 any liquid that is poured into the Tumblr 305 gets collected and the angle between the circular base 110 and they angle semicircular cylindrical base 108 inside the Tumbler 305. With a straw 306 the user can sip in all the liquid accumulated inside the Tumbler 305.

Figure 4:
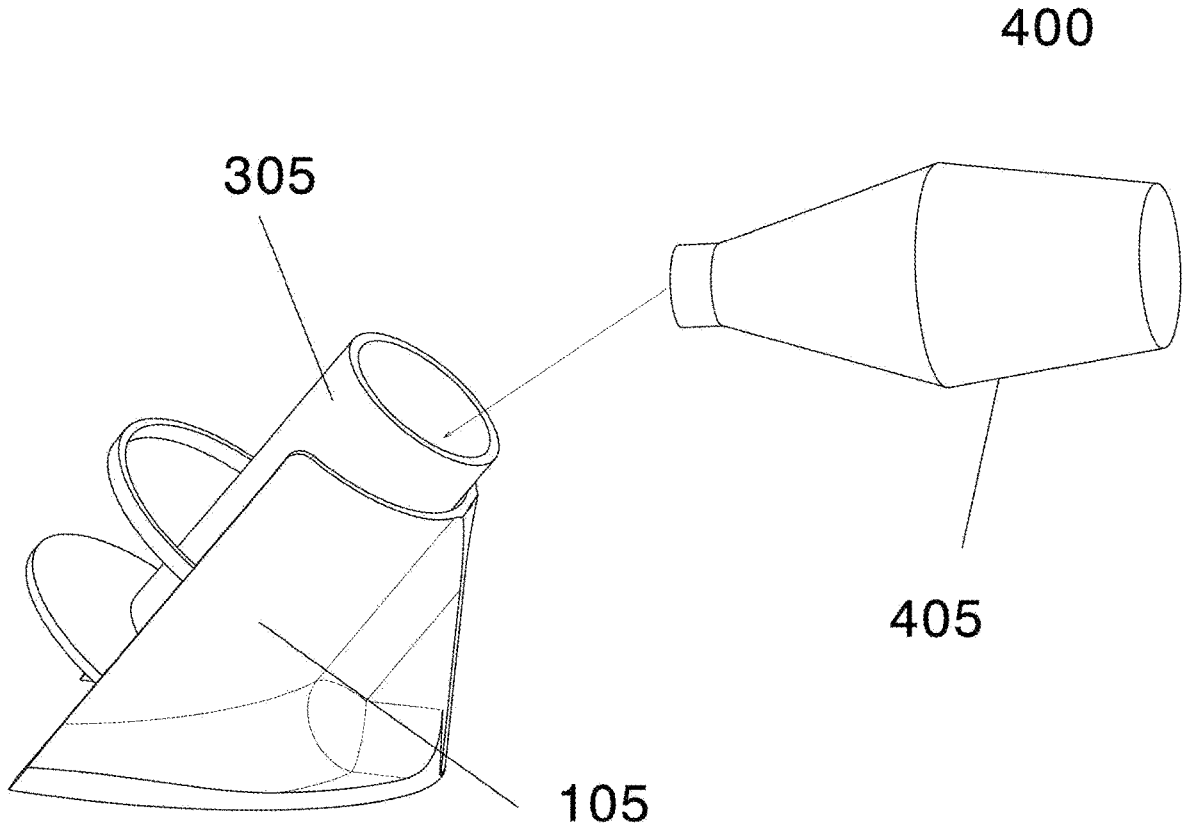
FIG. 4 shows a perspective of the holder device of the present invention in isometric view, with a tumbler and a bottle.

Referring now to FIG. 4, the holder device 105 holds the Tumblr 305 at an angle. A bottle 405 containing liquid is poured into the Tumblr 305 resting on the on the holder device 105. Due to the angle acquired by the Tumbler 305 from the holding device 105 the liquid poured on the wall of Tumblr 305 from bottle 405 does not generate foam and hence all the liquid from bottle 405 can be transferred into tumbler 305 without the need to weight for the form generated by pouring the liquid otherwise.

Figure 5:
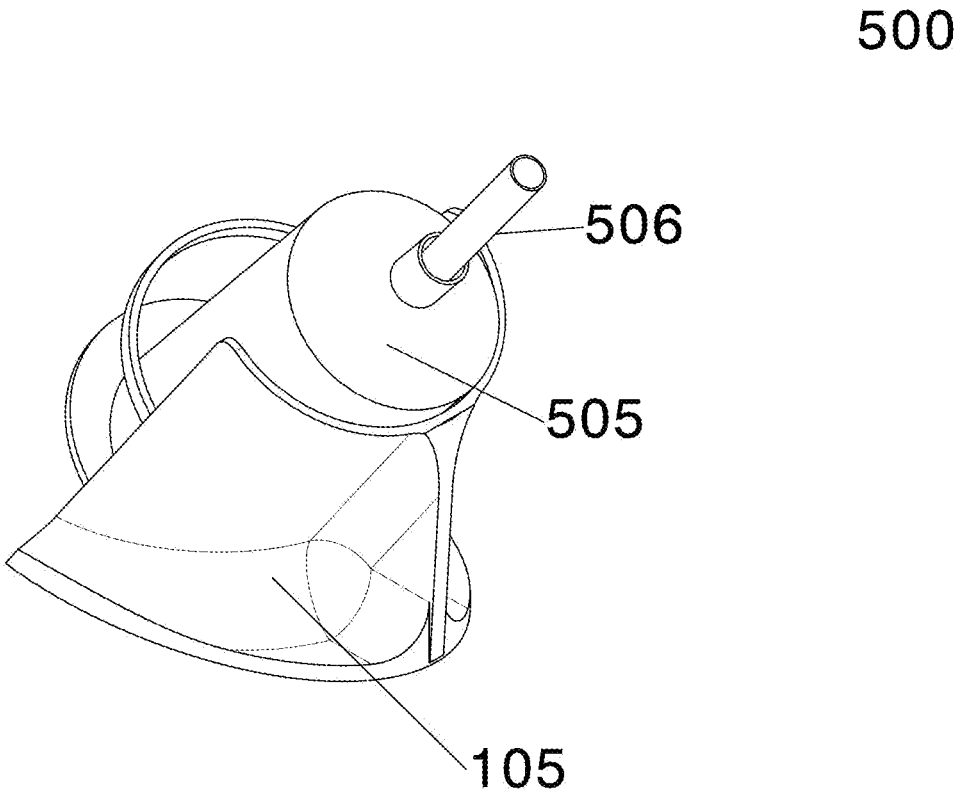
FIG. 5 shows a perspective of holder device of the present invention in isometric view, with a bottle and an inbuilt straw.

Referring now to FIG. 5 the holder device 105 holds water bottle 505 at an angle. Water bottle 505 inherits the angle from the holder device 105. This arrangement provides convenience for the user whose hands are occupied in other activity to take a sip of the liquid using the straw 506 from the water bottle 505. This circular rib 109 prevents the water bottle 505 from slipping from the circular base 110.

The invention claimed is:

1. A container supporting system, the system comprising:

a container;

a holder device made out of a flexible material which supports the container at an oblique angle relative to a supporting surface; wherein the holder device comprises:

a planar horseshoe shaped base which extends outward on opposing sides of the device;

a vertical rib intersecting the planar horseshoe shaped base and extending vertically upward therefrom;

an angled semi-circular cylinder base which rest on both said vertical rib and said planar horseshoe shaped base; the vertical rib extending upwardly from the planar horseshoe shaped base to join with an open top end of the angled semi-circular cylinder base such that the angled semi-circular cylinder base is prevented from bending forward when supporting the container;

a circular base which extends perpendicularly outward from the angled semi-circular cylindrical base and forms a support for a bottom of the container;

a semi-circular rib which projects perpendicularly away from the semi-cylindrical cylinder base with a first end attached to one side of the semi-cylindrical cylinder base and an opposed second end attached to an opposing side of the semi-cylindrical cylinder base; wherein the first end and the second end are spaced apart from the circular base such that the semi-circular rib is located away from the circular base;

a circled edge which transitions between the horseshoe shaped base and the angled semi-circular cylindrical base which provides support for the angled semi-circular cylindrical base; and wherein the container is supported on the circular base and located between the angled semi-circular cylinder base and the semi-circular rib, the container is positioned at the oblique angle relative to the supporting surface such that the container is accessible to a user.

2. The container supporting system according to claim 1, wherein the oblique angle configures the container to receive a liquid poured therein without generating foam.

3. The container supporting system according to claim 1, wherein the oblique angle configures the container to receive a powder poured therein from a scoop without requiring the use of the user's second hand and prevents spilling of the powder on the supporting surface.

4. The container supporting system according to claim 1, wherein the oblique angle configures the container to receive a foaming liquid without having to pause pouring of the foaming liquid.

5. The container supporting system according to claim 1, wherein the oblique angle configures the container for advertising the container.

6. The container supporting system according to claim 1, wherein the oblique angle configures the container to be out of view such that the user is able to access a digital screen with their hands.

7. The container supporting system according to claim 1, wherein the oblique angle configures the container so that the user can drive the contents of the container with a straw without use of the user's hands.

* * * * *